US012781330B2

(12) United States Patent
Kim et al.

(10) Patent No.: US 12,781,330 B2
(45) Date of Patent: Nov. 3, 2026

(54) PLATED STEEL WIRE AND MANUFACTURING METHOD FOR THE SAME

(71) Applicants: POSCO CO., LTD, Pohang-si (KR); KISWIRE LTD., Busan (KR); HONGDUK INDUSTRIAL CO., LTD., Pohang-si (KR)

(72) Inventors: Tae-Chul Kim, Gwangyang-si (KR); Jong-Sung Kim, Busan (KR); Sung-Hoon Kang, Busan (KR); Gwang-Weon Yu, Busan (KR); Il-Ryoung Sohn, Gwangyang-si (KR); Jong-Sang Kim, Gwangyang-si (KR)

(73) Assignees: POSCO CO., LTD, Pohang-si (KR); KISWIRE, LTD., Busan (KR); HONGDUK INDUSTRIAL CO., LTD., Pohang-si (KR)

( * ) Notice: Subject to any disclaimer, the term of this patent is extended or adjusted under 35 U.S.C. 154(b) by 111 days.

(21) Appl. No.: 18/519,969

(22) Filed: Nov. 27, 2023

(65) Prior Publication Data

US 2024/0093341 A1 Mar. 21, 2024

Related U.S. Application Data

(62) Division of application No. 17/622,085, filed as application No. PCT/KR2019/007726 on Jun. 26, 2019, now Pat. No. 11,834,747.

(51) Int. Cl.

*C23C 2/06* (2006.01)
*C22C 18/00* (2006.01)
(Continued)

(52) U.S. Cl.

CPC ..... *C23C 2/06* (2013.01); *C22C 18/00* (2013.01); *C23C 2/024* (2022.08); *C23C 2/26* (2013.01); *C23C 2/38* (2013.01)

(58) Field of Classification Search

CPC ..... C23C 2/06; C23C 18/00
See application file for complete search history.

(56) References Cited

U.S. PATENT DOCUMENTS

2003/0003321 A1 1/2003 Sugimaru et al.
2013/0183541 A1 7/2013 Kim et al.
(Continued)

FOREIGN PATENT DOCUMENTS

CN 107904532 A 4/2018
CN 108350555 A 7/2018
(Continued)

OTHER PUBLICATIONS

KR-101778440-B1 English translation. (Year: 2017).*
(Continued)

*Primary Examiner* — Hai Y Zhang
(74) *Attorney, Agent, or Firm* — Morgan Lewis & Bockius LLP

(57) ABSTRACT

A plated steel wire, according to one aspect of the present invention, comprises: a base steel wire; and a zinc alloy plated layer. The zinc alloy plated layer comprises, in percentage by weight: 1.0% to 3.0% of Al; 1.0% to 2.0% of Mg; 0.5% to 5.0% of Fe; and the balance being Zn and unavoidable impurities, and includes a Zn/MgZn2/Al ternary eutectic structure, a Zn single-phase structure, and an Fe—Zn-Al-based crystal structure, wherein the Fe—Zn-Al-based crystal structure is formed adjacent to the base steel wire, and can have an average thickness of ⅕ to ½ with respect to an average thickness of the zinc alloy plated layer.

4 Claims, 3 Drawing Sheets

(51) Int. Cl.

| | |
|---|---|
| ***C23C 2/02*** | (2006.01) |
| ***C23C 2/26*** | (2006.01) |
| ***C23C 2/38*** | (2006.01) |

(56) References Cited

U.S. PATENT DOCUMENTS

| | | | |
|---|---|---|---|
| 2018/0320260 | A1 | 11/2018 | Oh et al. |
| 2019/0100831 | A1 | 4/2019 | Oh et al. |
| 2020/0002798 | A1 | 1/2020 | Tokuda et al. |

FOREIGN PATENT DOCUMENTS

| | | | | |
|---|---|---|---|---|
| JP | H08-53779 | A | 2/1996 | |
| JP | 2002-285311 | A | 10/2002 | |
| JP | 2002-332555 | A | 11/2002 | |
| JP | 2014-501334 | A | 1/2014 | |
| JP | 2018-507321 | A | 3/2018 | |
| JP | 6365807 | B1 | 8/2018 | |
| KR | 10-2012-0075235 | A | 7/2012 | |
| KR | 10-2016-0078670 | A | 7/2016 | |
| KR | 10-2016-0078918 | A | 7/2016 | |
| KR | 10-1665883 | B1 | 10/2016 | |
| KR | 10-2017-0048651 | A | 5/2017 | |
| KR | 101778440 | B1 * | 9/2017 | ..... C22C 38/02 |
| KR | 10-2019-0078330 | A | 7/2019 | |
| WO | 2017/078195 | A1 | 5/2017 | |

OTHER PUBLICATIONS

International Search Report dated Mar. 26, 2020 issued in International Patent Application No. PCT/KR2019/007726 (with English translation).

U.S. Notice of Allowance dated Jul. 26, 2023 issued in U.S. Appl. No. 17/622,085.

Extended European Search Report dated Apr. 20, 2022 issued in European Patent Application No. 19935169.3.

Japanese Office Action dated Oct. 18, 2022 issued in Japanese Patent Application No. 2021-577188.

Office Action issued Mar. 14, 2024 for Chinese Patent Application No. 201980097811.9.

* cited by examiner

【Fig. 1】
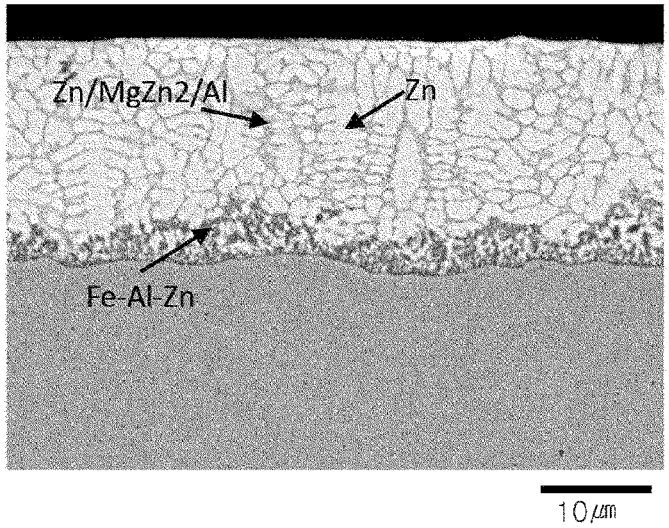
【Fig. 2】
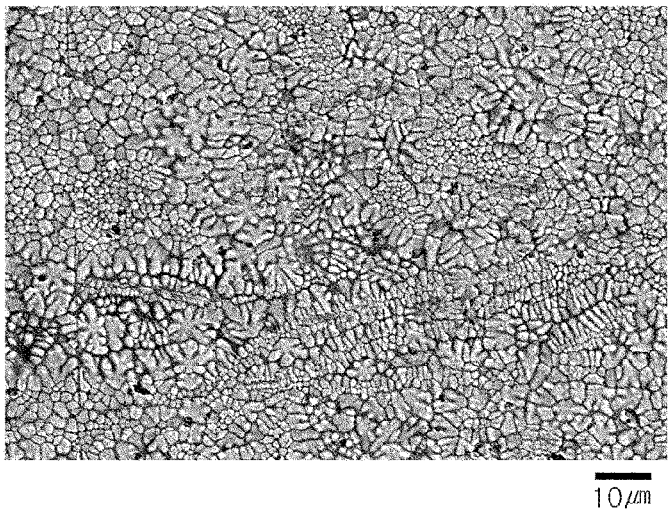

【Fig. 3】
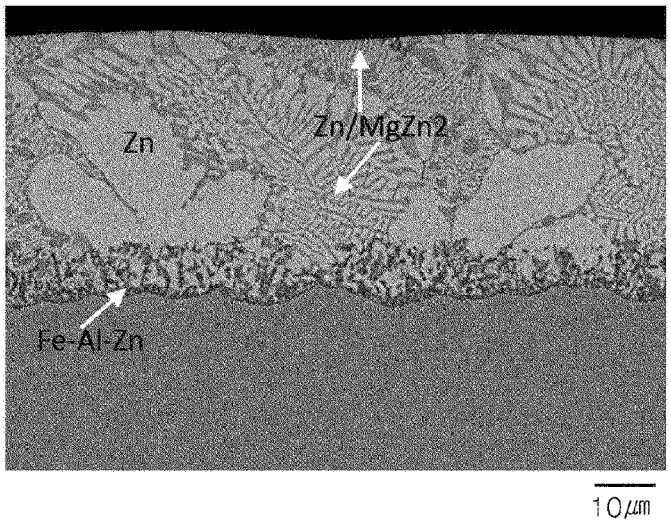
【Fig. 4】
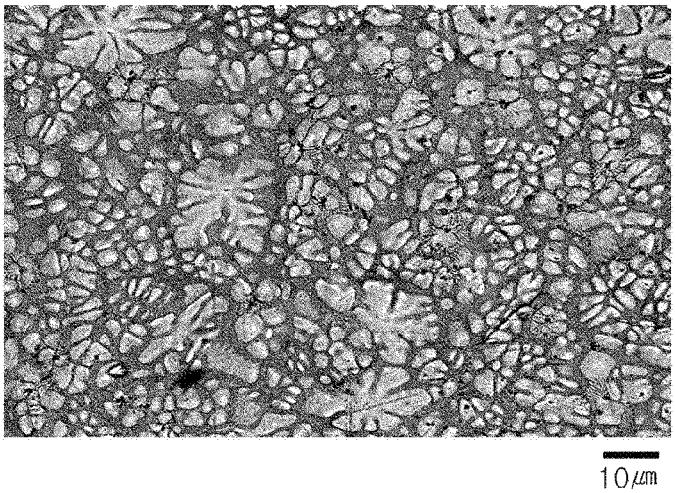

【Fig. 5】
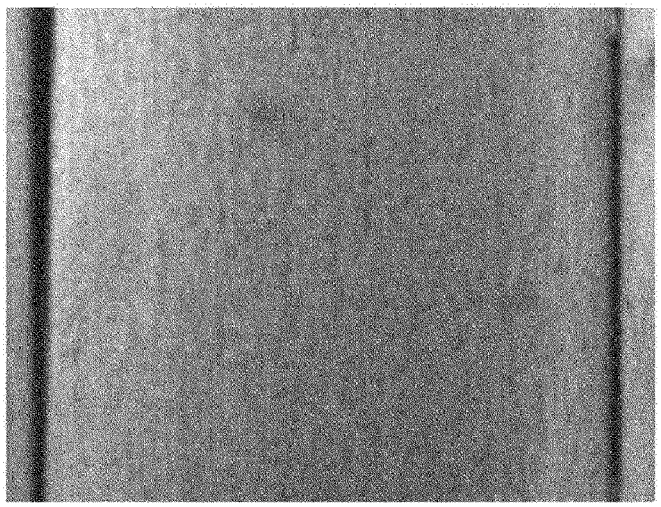
【Fig. 6】
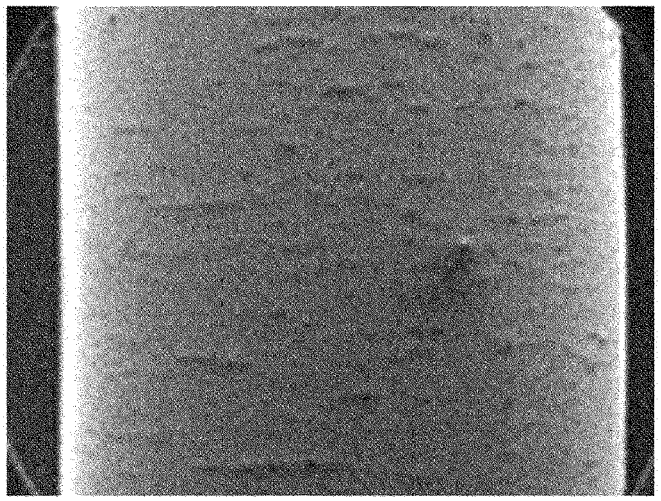

PLATED STEEL WIRE AND MANUFACTURING METHOD FOR THE SAME

CROSS-REFERENCE OF RELATED APPLICATIONS

This application is a Divisional Patent Application of U.S. patent application Ser. No. 17/622,085, filed on Dec. 22, 2021, which is the U.S. National Phase under 35 U.S.C. § 371 of International Patent Application No. PCT/KR2019/007726, filed on Jun. 26, 2019, the entire disclosures of which applications are incorporated by reference herein.

TECHNICAL FIELD

The present disclosure relates to a plated steel wire and a method for manufacturing the same, and more particularly, to a plated steel wire effectively securing processibility and corrosion resistance and a method for manufacturing the same.

BACKGROUND ART

A zinc plating method is excellent in an anticorrosive property and cost effectiveness, and thus has been widely used for manufacturing a steel having high corrosion resistance. In particular, a hot-dip zinc plated steel in which a plating layer is formed by dipping a steel in a hot-dip zinc plating bath has a simple manufacturing process and a low product price compared to a zinc electroplated steel. Therefore, demand for the hot-dip zinc plated steel has increased in various fields.

In the hot-dip zinc plated steel which a zinc plating layer is formed, sacrificial corrosion protection properties in which zinc (Zn) having an oxidation reduction potential lower than that of iron (Fe) is corroded first and corrosion of the steel is suppressed when exposed to a corrosive environment are exhibited, and the steel is protected from an oxidative atmosphere by a dense corrosion product that is formed on a surface of the steel as Zn of the zinc plating layer is oxidized. Therefore, corrosion resistance of the steel may be effectively improved.

However, air pollution has increased and worsening of a corrosive environment has been accelerated in accordance with high industrialization, and a demand for developing a steel having more excellent corrosion resistance than that of a conventional zinc plated steel has increased due to strict regulations on resource and energy saving.

A Zn—Al alloy plated steel wire has been developed to meet such a demand. In general, the Zn—Al alloy plated steel wire may be manufactured by subjecting a steel wire to a cleaning operation such as acid washing, washing, or degreasing, subjecting the cleaned steel wire to a flux treatment for an interfacial reaction activation with zinc, and then dipping the steel wire in a Zn-based plating bath containing Al.

RELATED ART DOCUMENT (Patent Document) Korean Patent Laid-Open Publication No. 10-2016-0078670 (published on Jul. 5, 2016)

DISCLOSURE

Technical Problem

An aspect of the present disclosure may provide a plated steel wire effectively securing processibility and corrosion resistance and a method for manufacturing the same.

An object of the present disclosure is not limited to the above description. Those skilled in the art will have no difficulty in understanding of further objects of the present disclosure from the overall descriptions of the present specification.

Technical Solution

According to an aspect of the present disclosure, a plated steel wire includes a base steel wire and a zinc alloy plating layer, wherein the zinc alloy plating layer contains, by wt %, 1.0 to 3.0% of Al, 1.0 to 2.0% of Mg, 0.5 to 5.0% of Fe, and a balance of Zn and unavoidable impurities, the zinc alloy plating layer includes a $Zn/MgZn_2/Al$ ternary eutectic structure, a Zn single-phase structure, and an Fe—Zn—Al-based crystal structure, and the Fe—Zn—Al-based crystal structure is formed adjacent to the base steel wire, and has an average thickness of ⅕ to ½ of an average thickness of the zinc alloy plating layer.

In a cross section of the zinc alloy plating layer, an area fraction occupied by the Zn single-phase structure in an area occupied by the $Zn/MgZn_2/Al$ ternary eutectic structure and the Zn single-phase structure may be 60% or more.

In a cross section of the zinc alloy plating layer, an average distance between columnar crystals in the Zn single-phase structure may be 1 to 5 μm.

According to another aspect of the present disclosure, a method for manufacturing a plated steel wire includes: primarily dipping a base steel wire in a hot-dip zinc plating bath to provide a zinc plated steel wire; secondarily dipping the primarily dipped zinc plated steel wire in a hot-dip zinc alloy plating bath to provide a zinc alloy plated steel wire; and cooling the secondarily dipped zinc alloy plated steel wire at a cooling rate of 15 to 50° C./s, wherein the hot-dip zinc alloy plating bath contains, by wt %, 1.0 to 3.0% of Al, 1.0 to 2.0% of Mg, and a balance of Zn and unavoidable impurities.

The base steel wire may be primarily dipped in the hot-dip zinc plating bath of 440 to 460° C. for 10 to 20 seconds.

The primarily dipped zinc plated steel wire may be cooled to a temperature equal to or lower than a melting point of Zn, and the cooled zinc plated steel wire may be secondarily dipped in the hot-dip zinc alloy plating bath.

The zinc plated steel wire may be secondarily dipped in the hot-dip zinc alloy plating bath of 440 to 460° C. for 10 to 20 seconds.

Advantageous Effects

As set forth above, according to an exemplary embodiment in the present disclosure, the plated steel wire having effectively improved processibility and corrosion resistance and the method for manufacturing the same may be provided.

DESCRIPTION OF DRAWINGS

FIG. 1 is an FE-SEM image obtained by observing a cross section of Inventive Example 1.

FIG. 2 is an FE-SEM image obtained by observing a surface of a plating layer of Inventive Example 1.

FIG. 3 is an FE-SEM image obtained by observing a cross section of Comparative Example 1.

FIG. 4 is an FE-SEM image obtained by observing a surface of a plating layer of Comparative Example 1.

FIG. 5 is an SEM image obtained by observing a surface of Inventive Example 1 after wire drawing.

FIG. 6 is an SEM image obtained by observing a surface of Comparative Example 1 after wire drawing.

BEST MODE FOR INVENTION

The present disclosure relates to a plated steel wire and a method for manufacturing the same. Hereinafter, preferred exemplary embodiments in the present disclosure will be described. The exemplary embodiments in the present disclosure may be modified in various forms, and the scope of the disclosure should not be interpreted to be limited to the exemplary embodiments set forth below. These exemplary embodiments are provided in order to describe the present disclosure in more detail to those skilled in the art to which the present disclosure pertains.

The plated steel wire according to an aspect of the present disclosure may include a base steel wire and a zinc alloy plating layer. The base steel wire of the present disclosure is not limited to a specific type of steel wire, and may be interpreted to include all types of steel wires used for hot-dip zinc plating or hot-dip zinc alloy plating.

In addition, the zinc alloy plating layer of the plated steel wire according to an aspect of the present disclosure may contain, by wt %, 1.0 to 3.0% of Al, 1.0 to 2.0% of Mg, 0.5 to 5.0% of Fe, and a balance of Zn and unavoidable impurities.

Hereinafter, a composition of the zinc alloy plating layer of the present disclosure will be described in more detail. Hereinafter, % related to a content of an alloy composition refers to wt %, unless otherwise particularly indicated.

Mg: 1.0 to 2.0%

Mg is an element that plays a very important role in improving corrosion resistance of the zinc alloy plating layer. Mg is contained in the zinc alloy plating layer, such that generation of zinc oxide-based corrosion products having a small corrosion resistance improvement effect in a severe corrosive environment may be suppressed, and zinc hydroxide-based corrosion products that are dense and have a large corrosion resistance improvement effect may be stabilized on a surface of the plating layer. Therefore, in order to achieve these effects, a content of Mg of the present disclosure may be 1.0% or more. However, when the content of Mn to be added is excessive, the corrosion resistance improvement effect according to the addition of Mg is saturated, and oxidation dross generated by oxidation of Mg is rapidly increased at a liquid level of a hot-dip zinc alloy plating bath. Therefore, the content of Mg of the present disclosure may be 2.0% or less.

Al: 1.0 to 3.0%

Al is an element added to reduce dross generated by an oxidation reaction of Mg in the hot-dip zinc alloy plating bath to which Mg is added. In addition, Al is an element that may improve corrosion resistance of the plated steel wire in combination with Zn and Mg. Therefore, in order to achieve these effects, a content of Al of the present disclosure may be 1.0% or more. A preferred content of Al may be 1.5% or more. However, when the content of Al to be added is excessive, the amount of Fe eluted from the steel wire dipped in the hot-dip zinc alloy plating bath is rapidly increased, and thus, Fe alloy-based dross may be generated. In addition, an Al—Zn metal structure is formed in the hot-dip zinc alloy plating bath, the temperature of the plating bath is thus increased, and the Al—Zn metal structure formed in the zinc alloy plating layer may inhibit processibility of the zinc alloy plating layer. Therefore, the content of Al of the present disclosure may be 3.0% or less. A preferred content of Al may be 2.8% or less.

Fe: 0.5 to 5.0%

Fe contained in the zinc alloy plating layer of the present disclosure is an element introduced into the zinc alloy plating layer by Fe—Zn formed by a reaction of Fe of the base steel wire with Zn of the hot-dip zinc alloy plating bath. The present disclosure is intended to secure adhesion of the plating layer by forming an Fe—Zn—Al-based crystal structure at an interfacial portion of the zinc alloy plating layer. Therefore, a content of Fe contained in the zinc alloy plating layer of the present disclosure may be 0.5% or more, and a preferred content of Fe may be 0.8% or more. On the other hand, when the content of Fe introduced into the zinc alloy plating layer is excessive, a hardness of the zinc alloy plating layer may be excessively increased, and a phenomenon in which local corrosion resistance is reduced may occur. Therefore, the content of Fe contained in the zinc alloy plating layer of the present disclosure may be 5.0% or less, and a preferred content of Fe may be 4.3% or less.

The zinc alloy plating layer of the present disclosure may contain a balance of Zn and other unavoidable impurities. The unavoidable impurities from raw materials or surrounding environments are unintentionally incorporated in a common steel manufacturing process and may not be excluded completely. Since these impurities may be recognized in the common steel manufacturing process by those skilled in the art, all the contents thereof are not particularly described in the present disclosure.

Hereinafter, a metal structure of the zinc alloy plating layer of the present disclosure will be described in more detail.

The zinc alloy plating layer of the present disclosure may include a $Zn/MgZn_2/Al$ ternary eutectic structure, a Zn single-phase structure, and an Fe—Zn—Al-based crystal structure. The Fe—Zn—Al-based crystal structure may be formed adjacent to the base steel wire, and may have an average thickness of ⅕ to ½ of an average thickness of the zinc alloy plating layer. That is, the Fe—Zn—Al-based crystal structure is formed from an interface with the base steel wire to a region with a thickness of ⅕ to ½ of the average thickness of the zinc alloy plating layer, such that adhesion between the zinc alloy plating layer and the base steel wire may be effectively secured. Therefore, when processing the plated steel wire of the present disclosure, it is possible to effectively prevent occurrence of cracks in the zinc alloy plating layer or peeling of the zinc alloy plating layer, such that the plated steel wire of the present disclosure may secure excellent processibility.

In a cross section of the zinc alloy plating layer, an area fraction occupied by the Zn single-phase structure in an area occupied by the $Zn/MgZn_2/Al$ ternary eutectic structure and the Zn single-phase structure may be 60% or more, and a preferred area fraction of the Zn single-phase structure may be 60 to 90%. In addition, columnar crystals in the Zn single-phase structure may be uniformly distributed at an average distance of 1 to 5 μm. Accordingly, the $Zn/MgZn_2/Al$ ternary eutectic structures may be uniformly distributed between the Zn single-phase structures. Therefore, the zinc alloy plating layer of the present disclosure includes the uniform Zn single-phase structures and $Zn/MgZn_2/Al$ ternary eutectic structures, such that the zinc alloy plating layer of the present disclosure may have uniform corrosion resistance.

Hereinafter, the method for manufacturing the plated steel wire of the present disclosure will be described in more detail.

The method for manufacturing the plated steel wire according to an aspect of the present disclosure may include:

primarily dipping a base steel wire in a hot-dip zinc plating bath to provide a zinc plated steel wire; secondarily dipping the primarily dipped zinc plated steel wire in a hot-dip zinc alloy plating bath to provide a zinc alloy plated steel wire; and cooling the secondarily dipped zinc alloy plated steel wire at a cooling rate of 15 to 50° C./s.

The hot-dip zinc plating bath of the present disclosure refers to a plating bath containing Zn as a main component, and may contain impurities unintentionally incorporated in a common plating bath preparing process. In addition, the hot-dip zinc plating bath of the present disclosure may refer to a plating bath close to pure Zn in which large amounts of alloy components such as Al and Mg are not artificially added. Therefore, the hot-dip zinc plating bath of the present disclosure may contain 95% or more of Zn, preferably 98% or more of Zn, and more preferably 99% or more of Zn.

Since a composition content of the hot-dip zinc alloy plating bath of the present disclosure corresponds to the reason for limiting the composition content of the zinc alloy plating layer described above, description of the reason for limiting the composition content of the hot-dip zinc alloy plating bath of the present disclosure is replaced with the description of the reason for limiting the composition content of the zinc alloy plating layer described above. However, since the Fe component of the zinc alloy plating layer is the component introduced from the base steel wire, the description related to the Fe component in the description of the composition content of the zinc alloy plating layer described above may be excluded from the description of the composition content of the hot-dip zinc alloy plating bath of the present disclosure.

Pre-Treatment and Primary Dipping

The base steel wire may be subjected to a cleaning treatment by processes such as acid washing, washing, and degreasing, and the cleaned base steel wire may be subjected to a flux treatment. The base steel wire subjected to such a pre-treatment process may be primarily dipped in a hot-dip zinc plating bath of 440 to 460° C. for 10 to 20 seconds to manufacture a zinc plated steel wire. Therefore, a zinc plating layer containing Zn as a main component may be formed in the primarily dipped zinc plated steel wire.

Preparation of Hot-Dip Zinc Alloy Plating Bath

A hot-dip zinc alloy plating bath containing, by wt %, 1.0 to 3.0% of Al, 1.0 to 2.0% of Mg, and a balance of Zn and unavoidable impurities may be prepared by using a predetermined Zn—Al—Mg-containing composite ingot or Zn—Mg and Zn—Al ingots containing individual components. A suitable temperature for melting these ingots may be 440 to 520° C. As the melting temperature of the ingot is higher, it is possible to secure fluidity and uniform composition in the plating bath and to reduce the amount of floating dross generated. Therefore, the ingot may be melted by being heated to 440° C. or higher. However, when the temperature of the hot-dip zinc alloy plating bath is higher than 520° C., ash-like surface defects are highly likely to occur due to evaporation of Zn. Therefore, it is preferable that the melting temperature of the ingot is also limited to 520° C. or lower. It is preferable that melting is initiated while maintaining the temperature of the hot-dip zinc alloy plating bath at 500 to 520° C. at the early stage of melting of the ingot, and then, the melting is completed while stabilizing the hot-dip zinc alloy plating bath at 440 to 480° C.

Secondary Dipping

The primarily dipped zinc plated steel wire is cooled to a temperature equal to or lower than the melting point of Zn, and the cooled zinc plated steel wire may be dipped in the hot-dip zinc alloy plating bath prepared through the process described above.

In general, when the content of Al among the components in the plating bath is increased, the melting point is increased, and thus, the equipment inside the plating bath is eroded to cause lifespan-shortening of the apparatus, and the amount of Fe alloy dross in the plating bath is increased to cause deterioration of a surface of a plating material. However, the content of Al in the hot-dip zinc-based plating bath of the present disclosure is 1.0 to 2.0%, which is relatively low. Therefore, it is not required to set the temperature of the hot-dip zinc alloy plating bath higher than necessary. Accordingly, a common plating bath temperature may be applied to the temperature of the hot-dip zinc alloy plating bath provided for the secondary dipping, and a temperature of 440 to 480° C. may be preferably applied. In addition, the time for the secondary dipping may be also appropriately applied in consideration of the thickness of the zinc alloy plating layer and the like, and the secondary dipping may be preferably performed for 10 to 20 seconds.

The zinc plating layer formed on the surface of the base steel plate by the primary dipping may be partially or entirely melted again during the secondary dipping, and at this time, an Al component contained in a zinc alloy plating solution may diffuse and move toward the interface with the base steel wire.

Cooling

The secondarily dipped zinc alloy plated steel wire may be cooled at a cooling rate of 15 to 50° C./s, and the zinc alloy plated steel wire may be preferably cooled at a cooling rate of 15 to 50° C./s immediately after the completion of the secondary dipping. That is, the cooling may be initiated from a bath surface of the hot-dip zinc alloy plating bath. In order to prevent coarsening of columnar crystals in the Zn single-phase structure and to prevent formation of a $Zn/MgZn_2$ binary eutectic structure, the cooling rate of the present disclosure may be 15° C./s or more. When an average distance between the columnar crystals in the Zn single-phase structure exceeds 5 μm, the columnar crystals in the Zn single-phase structure are excessively coarsened. Therefore, uniform corrosion resistance may not be secured. In addition, the $Zn/MgZn_2$ binary eutectic structure formed in the plating layer causes cracks during processing of the plated steel wire, which may impair uniform corrosion resistance and processibility. On the other hand, when the cooling rate is excessive, the columnar crystals in the Zn single-phase structure may be excessively refined, resulting in locally uneven corrosion resistance, and the diffusion of the Fe—Zn—Al-based structures is insufficient, resulting in formation of a crystal structure due to concentration of the Fe—Zn—Al-based structures at an interfacial layer. Therefore, a binding force between the zinc alloy plating layer and the base steel wire is not sufficient. As a result, processibility of the plated steel wire may deteriorate.

The cooling of the present disclosure may be performed by supplying an inert gas such as nitrogen, argon, or helium, and relatively inexpensive nitrogen may be preferable in terms of reducing manufacturing costs.

MODE FOR INVENTION

Hereinafter, the present disclosure will be described in more detail with reference to Inventive Examples.

Inventive Examples

A steel wire containing, by wt %, 0.82% of C, 0.2% of Si, 0.5% of Mn, 0.003% of P, and a balance of Fe and unavoidable impurities and having a diameter of 5 mm was prepared as a sample, the steel wire was subjected to degreasing and acid washing, and the steel wire was subjected to a flux treatment using a flux containing zinc chloride ($ZnCl_2$) and ammonium chloride ($NH_4Cl$) as main components. Thereafter, the steel wire treated with the flux was primarily dipped in a hot-dip zinc plating bath containing 0.2 wt % of Al and heated to 460° C. for 15 seconds, an average thickness of the hot-dip zinc plating layer was adjusted to 20 μm, and the hot-dip zinc plating layer was cooled to a temperature equal to or lower than a melting point of Zn. Thereafter, the hot-dip zinc plating layer was dipped in an Zn—Mg—Al-based plating bath of 460° C. containing the composition (excluding the Fe component) corresponding to the composition of the plating layer shown in Table 1 for 15 seconds, and then, plated steel wires were manufactured by applying different cooling conditions.

After each of the manufactured plated steel wires was cut in a direction perpendicular to a longitudinal direction, a cross section was imaged with a field emission scanning electron microscope (FE-SEM), and an area fraction of a Zn single-phase structure, an average distance between columnar crystals in the Zn single-phase structure, and the presence or absence and a distribution of each of a $Zn/MgZn_2/Al$ ternary eutectic structure and a $Zn/MgZn_2$ binary eutectic structure in a cross section of the plating layer were measured based on the imaging results. The area fraction of the Zn single-phase structure refers to an area fraction occupied by the Zn single-phase structure in an area occupied by the Zn single-phase structure and the $Zn/MgZn_2/Al$ ternary eutectic structure in the cross section of the plating layer.

Thereafter, each of the plated steel wires was drawn at a diameter reduction rate of 80% and processed into a 1 mm plated steel wire for processibility evaluation, and a surface appearance and corrosion resistance of the processed plated steel wire were evaluated. The surface appearance was evaluated by imaging a surface of the drawn plated steel wire using an SEM and was determined based on the presence or absence of cracks in the corresponding image. The corrosion resistance was evaluated by carrying out a salt water spraying test on each of the drawn plated steel wires. That is, each of the plated steel wires was charged in a salt water spraying tester, and a red rust occurrence time was measured according to the international standard (ASTM B117-11). Specifically, in the salt water spraying tester, salt water (temperature: 35° C., pH: 6.8) having a concentration of 5% was sprayed at a spraying rate of 2 ml/80 $cm^2$ per hour. It was expressed as "◎" when the red rust occurrence time for each of the plated steel wires was 300 hours or longer, "○" when the red rust occurrence time for each of the plated steel wires was 200 hours or longer and shorter than 300 hours, "Δ" when the red rust occurrence time for each of the plated steel wires was 100 hours or longer and shorter than 200 hours, and "x" when the red rust occurrence time for each of the plated steel wires was shorter than 100 hours. In general, when the red rust occurrence time in the salt water spraying test is 300 hours or longer, excellent corrosion resistance may be secured even in a severe oxidative environment.

TABLE 1

| Classification | Composition of plating layer (wt %) Al | Mg | Fe | Cooling rate (° C./s) | Area fraction of Zn single-phase structure (%) | Average distance between columnar crystals in Zn single-phase structure (μm) | Thickness ratio of Fe—An—Al—based crystal structure (t:thickness of plating layer) | Presence or absence of cracks after wire drawing | Salt water spraying evaluation after wire drawing Time (h) | Evaluation |
|---|---|---|---|---|---|---|---|---|---|---|
| Inventive Example 1 | 2.0 | 1.7 | 0.8 | 30 | 85 | 3 | t/5 | Absence | 350 | ◎ |
| Inventive Example 2 | 1.5 | 1.5 | 3.5 | 25 | 90 | 3.5 | t/3 | Absence | 320 | ◎ |
| Inventive Example 3 | 2.5 | 2.0 | 2.5 | 40 | 75 | 2 | t/4 | Absence | 400 | ◎ |
| Inventive Example 4 | 2.8 | 1.2 | 4.3 | 20 | 70 | 4 | t/2 | Absence | 370 | ◎ |
| Comparative Example 1 | 2.5 | 3.0 | 2.4 | 5 | 50 | 15 | t/6 | Presence | 130 | Δ |
| Comparative Example 2 | 1.8 | 3.0 | 2.2 | 10 | 70 | 10 | t/8 | Presence | 80 | X |
| Comparative Example 3 | 5.0 | 2.0 | 0.2 | 15 | 50 | 8 | t/7 | Presence | 75 | X |
| Comparative Example 4 | 1.0 | 0.9 | 1.5 | 20 | 80 | 6 | t/9 | Absence | 150 | Δ |

In Inventive Examples 1 to 4, the conditions of the present disclosure were satisfied, and thus, it could be confirmed that no cracks occurred after wire drawing, and in the salt water spraying evaluation, the red rust occurred after 300 hours had elapsed. On the other hand, in Comparative Examples 1 to 4, the conditions of the present disclosure were not satisfied, and thus, it could be confirmed that cracks occurred after wire drawing, and in the salt water spraying evaluation, the red rust occurred within 200 hours.

FIG. 1 is an FE-SEM image obtained by observing the cross section of Inventive Example 1, and FIG. 2 is an FE-SEM image obtained by observing the surface of the plating layer of Inventive Example 1.

As illustrated in FIGS. 1 and 2, it could be confirmed that in Inventive Example 1, the area fraction of the Zn single-phase structure was about 85%, and the average distance between the columnar crystals in the Zn single-phase structure was 3 μm, which showed that the columnar crystals in the Zn single-phase structure were finely formed. In addition, it could be confirmed that in Inventive Example 1, the Fe—Zn—Al-based crystal structure was formed at a thickness of about ⅕ of the thickness of the entire plating layer from the interface, and the $Zn/MgZn_2/Al$ ternary eutectic structures were evenly distributed between the Zn single-phase structures.

FIG. 3 is an FE-SEM image obtained by observing the cross section of Comparative Example 1, and FIG. 4 is an FE-SEM image obtained by observing the surface of the plating layer of Comparative Example 1.

As illustrated in FIGS. 3 and 4, it could be confirmed that in Comparative Example 1, the area fraction of the Zn single-phase structure was about 50%, and the average distance between the columnar crystals in the Zn single-phase structure was 15 μm, which showed that the columnar crystals in the Zn single-phase structure were coarsely formed. In addition, it could be confirmed that in Comparative Example 1, the Fe—Zn—Al-based crystal structure was formed at a thin thickness of about ⅙ of the thickness of the entire plating layer from the interface, and the structures were non-uniformly distributed as a whole due to the mixed coarse $Zn/MgZn_2$ binary eutectic structures.

FIG. 5 is an SEM image obtained by observing the surface of Inventive Example 1 after wire drawing, and FIG. 6 is an SEM image obtained by observing the surface of Comparative Example 1 after wire drawing.

As illustrated in FIG. 5, it could be confirmed that in Inventive Example 1, no cracks occurred on the surface of the plating layer after wire drawing. On the other hand, as illustrated in FIG. 6, it could be confirmed that in Comparative Example 1, cracks occurred on the surface of the plating layer after wire drawing.

Therefore, according to an exemplary embodiment in the present disclosure, the plated steel wire effectively securing processibility and corrosion resistance and the method for manufacturing the same may be provided.

Hereinabove, the present disclosure has been described in detail by the exemplary embodiments, but other exemplary embodiments having different forms are possible. Therefore, the technical spirit and scope of the claims set forth below are not limited by the exemplary embodiments.

The invention claimed is:

1. A method for manufacturing a plated steel wire, comprising:

primarily dipping a base steel wire in a hot-dip zinc plating bath to provide a zinc plated steel wire;

secondarily dipping the primarily dipped zinc plated steel wire in a hot-dip zinc alloy plating bath to provide a zinc alloy plated steel wire; and immediately after the completion of the secondarily dipping, cooling the secondarily dipped zinc alloy plated steel wire at a cooling rate of 15 to 50° C./s, wherein the hot-dip zinc alloy plating bath contains, by wt %, 1.0 to 3.0% of Al, 1.0 to 2.0% of Mg, and a balance of Zn and unavoidable impurities.

2. The method of claim 1, wherein the base steel wire is primarily dipped in the hot-dip zinc plating bath of 440 to 460° C. for 10 to 20 seconds.

3. The method of claim 1, wherein the primarily dipped zinc plated steel wire is cooled to a temperature equal to or lower than a melting point of Zn, and the cooled zinc plated steel wire is secondarily dipped in the hot-dip zinc alloy plating bath.

4. The method of claim 1, wherein the zinc plated steel wire is secondarily dipped in the hot-dip zinc alloy plating bath of 440 to 460° C. for 10 to 20 seconds.

* * * * *